US005605062A

United States Patent [19]

Park

[11] Patent Number: 5,605,062

[45] Date of Patent: Feb. 25, 1997

[54] WASHING MACHINE HAVING AN ECCENTRIC LINK FOR PREVENTING A TANGLING OF WASHING OBJECTS

[75] Inventor: Kwan C. Park, Kwang-Ju, Rep. of Korea

[73] Assignee: Daewoo Electronics Co., Ltd., Seoul, Rep. of Korea

[21] Appl. No.: 499,475

[22] Filed: Jul. 7, 1995

[30] Foreign Application Priority Data

Nov. 29, 1994 [KR] Rep. of Korea ..... 1994/31832

[51] Int. Cl.[6] ..... D06F 17/08

[52] U.S. Cl. ..... 68/131

[58] Field of Search ..... 68/131, 133, 26

[56] References Cited

U.S. PATENT DOCUMENTS 2,105,218 1/1938 Kirby ..... 68/133 X 2,619,827 12/1952 Castricone ..... 68/133

2,755,651 7/1956 Castricone ..... 68/131

2,821,076 1/1958 Castricone ..... 68/131

FOREIGN PATENT DOCUMENTS 833665 4/1960 United Kingdom ..... 68/131

*Primary Examiner*—Philip R. Coe

*Attorney, Agent, or Firm*—Fish & Richardson, P.C.

[57] ABSTRACT

A washing machine for reducing a tangling of washing objects is disclosed. The washing machine includes an eccentric link having a base plate, an upper shaft formed on an upper surface of the base plate, and a lower shaft formed on a lower surface of the base plate and eccentrically disposed with respect to the upper shaft. In the washing machine, the upper shaft circularly moves around the lower shaft as the lower shaft is rotated on its own shaft so that a pulsator secured to the upper shaft is pseudo-rotating, and thereby an irregular liquid flow is generated in a washing tub.

5 Claims, 5 Drawing Sheets

WASHING MACHINE HAVING AN ECCENTRIC LINK FOR PREVENTING A TANGLING OF WASHING OBJECTS

BACKGROUND OF THE INVENTION

1. Field of the Invention

The present invention relates to a washing machine, and more particularly to a washing machine having an eccentric link which can make a pulsator pseudo-rotate for preventing a tangling of washing objects.

2. Prior Arts

Generally, washing machines are classified into a pulsator type washing machine, an agitator type washing machine, and a drum type washing machine according to the washing manner.

Among those washing machines, the pulsator type washing machine has a pulsator, which is rotatably mounted in a lower portion of a washing tub, as a liquid flow generating member. In the pulsator type washing machine, the pulsator driven by a motor generates a swirl shaped liquid flow in the washing tub, and the swirl shaped liquid flow that has been generated in the washing tub impacts on washing objects so that the washing objects can be washed.

The pulsator type washing machines are widely used as a household washing machine and are divided into a two-tub type washing machine having a washing tub and a dehydration tub separately, and an one-tub type washing machine having a washing tub, which is performing both a washing operation and Since the present invention relates to the pulsator type washing machine, washing machines of other types such as the agitator type and drum type will not be further described in this specification. Hereinafter, washing machines described in this specification mean the pulsator type washing machine.

FIG. 5 is a sectional view for showing a conventional two-tub type washing machine 400.

As shown in FIG. 5, two-tub type washing machine 400 comprises a washing tub 410 for receiving washing objects, a pulsator 420 rotatably mounted in a lower portion of washing tub 410 so as to generate a liquid flow in washing tub 410, a pulsator driving section 430 for driving pulsator 420, a dehydration tub 450 separately installed with respect to washing tub 410 and having a plurality of openings 452 on its side wall, and a dehydration tub driving section 470 for driving dehydration tub 450.

Pulsator driving section 430 includes a washing motor 432, which is generating a driving force for rotating pulsator 420 and having a motor shaft 434, a first pulley 433 connected to motor shaft 434, pulsator drive shaft 438 secured to a center of pulsator 420 by a bolt 424 and extended downwards therefrom, and a second pulley 436 connected to pulsator drive shaft 438. First pulley 433 and second pulley 436 are interconnected to each other by a belt 435 in such a manner that the driving force of washing motor 432 can be transferred to pulsator 420.

Dehydration tub driving section 470 includes a dehydration motor 478, which generates a driving force for rotating dehydration tub 450 and having a motor shaft 472, a dehydration tub drive shaft 476 disposed between dehydration tub 450 and dehydration motor 478 so as to transfer the driving force of dehydration motor 478 to dehydration tub 450, and a coupling 474 for binding dehydration tub drive shaft 476 and motor shaft 472 of dehydration motor 478 together.

On the other hand, a washing timer 490 for adjusting a washing time, and a dehydration timer 492 for adjusting a dehydration time, each of which is respectively connected to washing motor 432 and dehydration motor 478, are installed on an upper portion of washing machine 400.

The operation of the conventional two-tub type washing machine having construction as described above is as follows.

Firstly, in the event of a washing operation, a user puts washing objects into washing tub 410. In this state, when the user turns washing timer 490 on, washing motor 432 connected to washing timer 490 is driven. The driving force of washing motor 432 is transferred to pulsator drive shaft 438 through motor shaft 434 of washing motor 432, first pulley 433, and second pulley 436 so that pulsator 420 secured to pulsator drive shaft 438 is rotated, and thereby a liquid flow is generated in washing tub 410. The liquid flow that has been generated in washing tub 410 impacts on washing objects, which have been accommodated in washing tub 410, and thereby the washing objects can be washed. Washing time for washing the washing objects is adjustable by adjusting washing timer 490.

Then, when the washing operation has finished, the user takes washed washing objects out of washing tub 410 and puts the washed washing objects into dehydration tub 450. In this state, when the user turns dehydration timer 492, dehydration motor 478 connected to dehydration timer 492 is driven. The driving force of dehydration motor 478 is transferred to dehydration tub 450 through dehydration tub drive shaft 476, which is connected to motor shaft 472 of dehydration motor 478, so that dehydration tub 450 is rotated. At this time, the washing objects accommodated in dehydration tub 450 are subjected to centrifugal force so that the washing objects are forced radially outward of dehydration tub 450, i.e., toward a side wall of dehydration tub 450, and thereby washing liquid contained in the washed washing objects is drained into an exterior of washing machine 400 through a plurality of openings 452 formed in the side wall of dehydration tub 450. Dehydration time for dehydrating the washing liquid contained in the washing objects is also adjustable by adjusting dehydration timer 490.

However, the conventional two-tub type washing machine constructed as described above has the following disadvantages.

Firstly, since the center of rotation of pulsator 420 for generating a liquid flow in washing tub 410 is maintained in a constant position during the washing operation, the liquid flow generated by the rotation of pulsator 420 is formed as a concentric swirl shape so that the washing objects rotated along the liquid flow become tangled with each other.

Further, when the R.P.M.(revolution per minute) of pulsator 420 increases, the centrifugal force of the liquid flow becomes stronger so that the washing objects collide more strongly with the side wall of washing tub 410. The strong collision between the washing objects and the side wall of washing tub 410 will cause damage to the washing objects. To the contrary, when the R.P.M. of pulsator 420 decrease, the washing objects are not cleanly washed.

Accordingly, there has been a necessity to provide a washing machine which not only prevents the tangling of the washing objects but also reduces the damage of the washing objects during the washing operation of the washing machine.

SUMMARY OF THE INVENTION

The present invention has been made to overcome the above described problems of the prior arts, and accordingly it is an object of the present invention to provide a washing machine which not only prevents the tangling of the washing objects (such as clothes to be washed) but also reduces the damage to the washing objects during the washing operation of the washing machine.

To achieve the above object, the present invention provides a washing machine comprising:

a washing tub for receiving washing objects, the washing tub having a bellows at its bottom wall, the bellows having a moving area at its center portion and being made of a flexible material;

a pulsator mounted above the bottom wall of the washing tub and having a plurality of blades for generating a liquid flow in the washing tub;

an eccentric link having a base plate, an upper shaft formed on an upper surface of the base plate and connected to the pulsator, and a lower shaft formed on a lower surface of the base plate and connected to the pulsator driving section, the upper shaft being eccentrically disposed with respect to the lower shaft in such a manner that the upper shaft can circularly move about the lower shaft as the lower shaft is rotated on its own axis, the base plate having a weighty portion formed thicker than remaining portion of the base plate so as to maintain the center of gravity of eccentric link constant, the upper shaft passing through the bellows, the upper shaft and the lower shaft are disposed in opposite direction from each other and formed integrally with the base plate; and a pulsator driving section having a washing motor for generating a rotational force, a first pulley receiving the rotational force from the washing motor through a motor shaft so as to be rotated thereof, a second pulley connected to the lower shaft of the eccentric link, and a belt for connecting the first pulley to the second pulley, wherein, the eccentric link is disposed between the pulsator driving section and the pulsator, and is receiving a rotational force from the pulsator driving section so as to pseudo-rotate the pulsator in the washing tub, the pulsator is secured to the upper shaft of the eccentric link so that the pulsator is circularly moved around the lower shaft together with the upper shaft as the lower shaft is rotated on its own axis, and thereby an irregular liquid flow is generated in the washing tub.

The washing machine being constructed as described above according to the present invention is operated as follows.

In the event of a washing operation, a user puts washing objects into the washing tub. In this state, when the user turns the washing timer on, the washing motor connected to the washing timer is driven. The driving force of the washing motor is transferred to the lower shaft of the eccentric link through the pulsator driving section so that the lower shaft of the eccentric link rotates. As the lower shaft of the eccentric link rotates, the upper shaft which is eccentrically disposed with respect to the rotation axis of the lower shaft, moves circularly so that the pulsator secured to the upper shaft of the eccentric link moves circularly along the upper shaft of the eccentric link.

The pseudo-rotated pulsator generates an irregular liquid flow in the washing tub different from the liquid flow generated by the rotation movement of the conventional pulsator so that the tangling of the washing objects moved along the liquid flow in the washing tub can be reduced. In addition, since a center of pseudo-rotated pulsator is circularly moved, centrifugal force is reduced so that the washing objects do not in collide with the side wall of the washing tub strongly, and thereby the damage of the washing objects can be reduced.

BRIEF DESCRIPTION OF THE DRAWINGS

The above objects and other advantages of the present invention will become more apparent by describing in detail preferred embodiments thereof with reference to the attached drawings, in which.

DESCRIPTION OF THE PREFERRED EMBODIMENTS

Hereinafter, the present invention will be described in detail with reference to the accompanying drawings.

Figure 1:
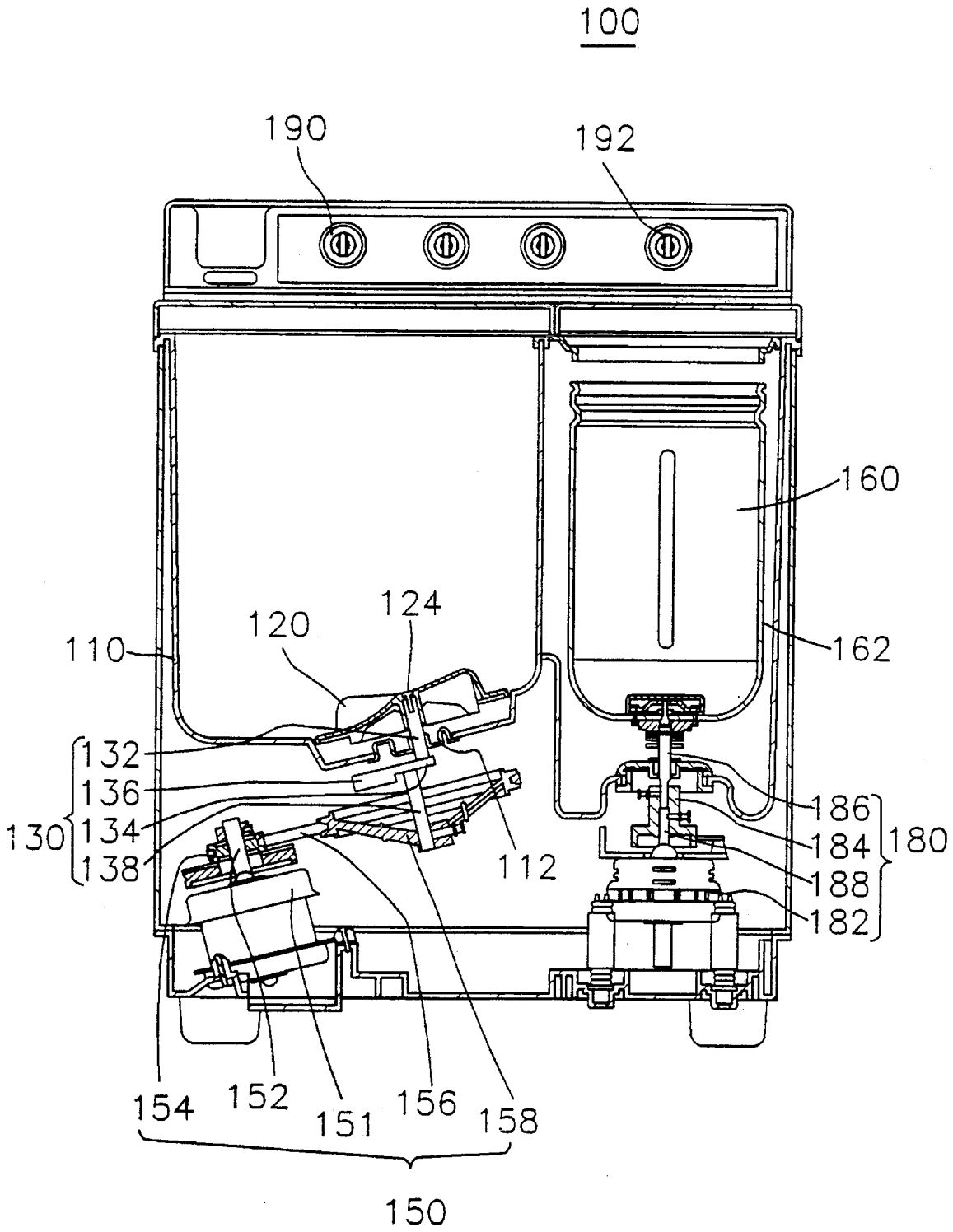
FIG. 1 is a sectional view of a two-tub type washing machine according to one embodiment of the present invention.

FIG. 1 is a sectional view of a two-tub type washing machine 100 according to one embodiment of the present invention.

As shown in FIG. 1, two-tub type washing machine 100 according to one embodiment of the present invention has a washing tub 110 for receiving washing objects, a pulsator 120 mounted in a lower portion of washing tub 110 and having a plurality of blades 122 so as to generate a liquid flow, a pulsator driving section 150 for driving pulsator 120, an eccentric link 130 disposed between pulsator 120 and pulsator driving section 150 so as to transfer a driving force from pulsator driving section 150 to pulsator 120, a dehydration tub 160 separately disposed in washing machine 100 for dehydrating a washing liquid contained in washed washing objects and having a plurality of openings 162 formed on its side wall, and a dehydration tub driving section 180 for driving dehydration tub 160.

Bellows 112, into which eccentric link 130 passes through, are formed in a bottom wall of washing tub 110.

Figure 2:
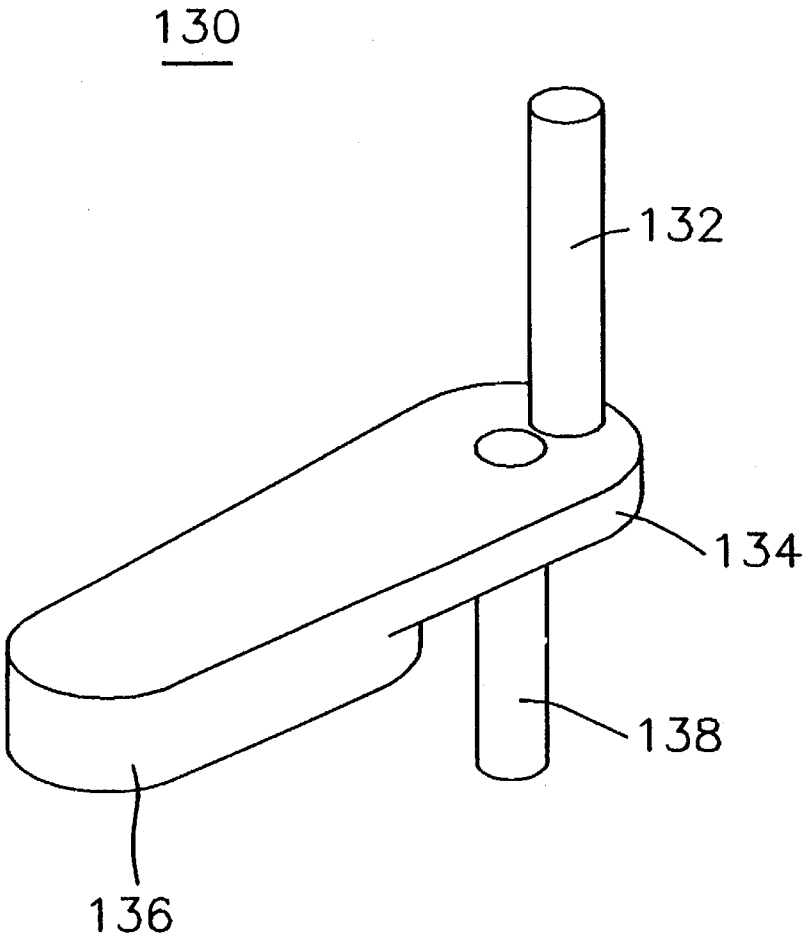
FIG. 2 is an enlarged perspective view of an eccentric link as shown in FIG. 1.

As shown in FIG. 2 in detail, eccentric link 130 has a base plate 134, an upper shaft 132 formed on an upper surface of base plate 134 and extended upwards therefrom, and a lower shaft 138 formed on a lower surface of base plate 134 and extended downwards therefrom.

Upper shaft 132 of eccentric link 130 is coupled to a center of pulsator 120 by means of a bolt 124. Lower shaft 138 of eccentric link 130 is connected to washing tub driving section 150 and rotates on its own axis as the driving force is transferred from washing tub driving section 150 to lower shaft 138. Upper shaft 132 is eccentrically disposed with respect to a rotation axis of lower shaft 136, and base plate 134 has a weighty portion 138, which is formed thicker than the remaining portion of base plate 134, for constantly maintaining the center of gravity of eccentric link 130. In addition, upper shaft 132 and lower shaft 138 of eccentric link 130 are disposed in opposite direction from each other, and are formed integrally with base plate 132.

Referring again to FIG. 1, pulsator driving section 150 includes a washing motor 151, which is generating a driving force for rotating pulsator 120 and having a motor shaft 152, a first pulley 154 which is connected to motor shaft 152, and a second pulley 158 which is connected to lower shaft 138 of eccentric link 130. First pulley 154 and second pulley 158 are interconnected to each other by a belt 156 in such a manner that the driving force of washing motor 151 can be transferred to eccentric link 130.

Dehydration tub driving section 180 includes a dehydration motor 182, which is generating a driving force for rotating dehydration tub 160 and having a motor shaft 188, a dehydration tub drive shaft 186 disposed between dehydration tub 160 and dehydration motor 182 so as to transfer the driving force of dehydration motor 182 to dehydration tub 160, and a coupling 184 for binding dehydration tub drive shaft 186 and motor shaft 188 of dehydration motor 182 together.

On the other hand, a washing timer 190 for adjusting a washing time and a dehydration timer 192 for adjusting a dehydration time, each of which is respectively connected to washing motor 151 and dehydration motor 182, are installed on an upper portion of washing machine 100.

Two-tub type washing machine 100 being constructed as described above according to one embodiment of the present invention is operated as follows.

In the event of a washing operation, a user puts washing objects into washing tub 110. In this state, when the user turns washing timer 190 on, washing motor 151 connected to washing timer 190 is driven. The driving force of washing motor 151 is transferred to lower shaft 138 of eccentric link 130 through motor shaft 152 of washing motor 151, first pulley 154, belt 156 and second pulley 158 so that lower shaft 138 of eccentric link 130 rotates. As lower shaft 138 of eccentric link 130 rotates, upper shaft 132, which is eccentrically disposed with respect to the rotation axis of lower shaft 138, moves circularly about lower shaft 138 while forming a constant circular orbit so that pulsator secured to upper shaft 132 of eccentric link 130 by belt 124 moves circularly along upper shaft 132 of eccentric link 130.

Figure 3:
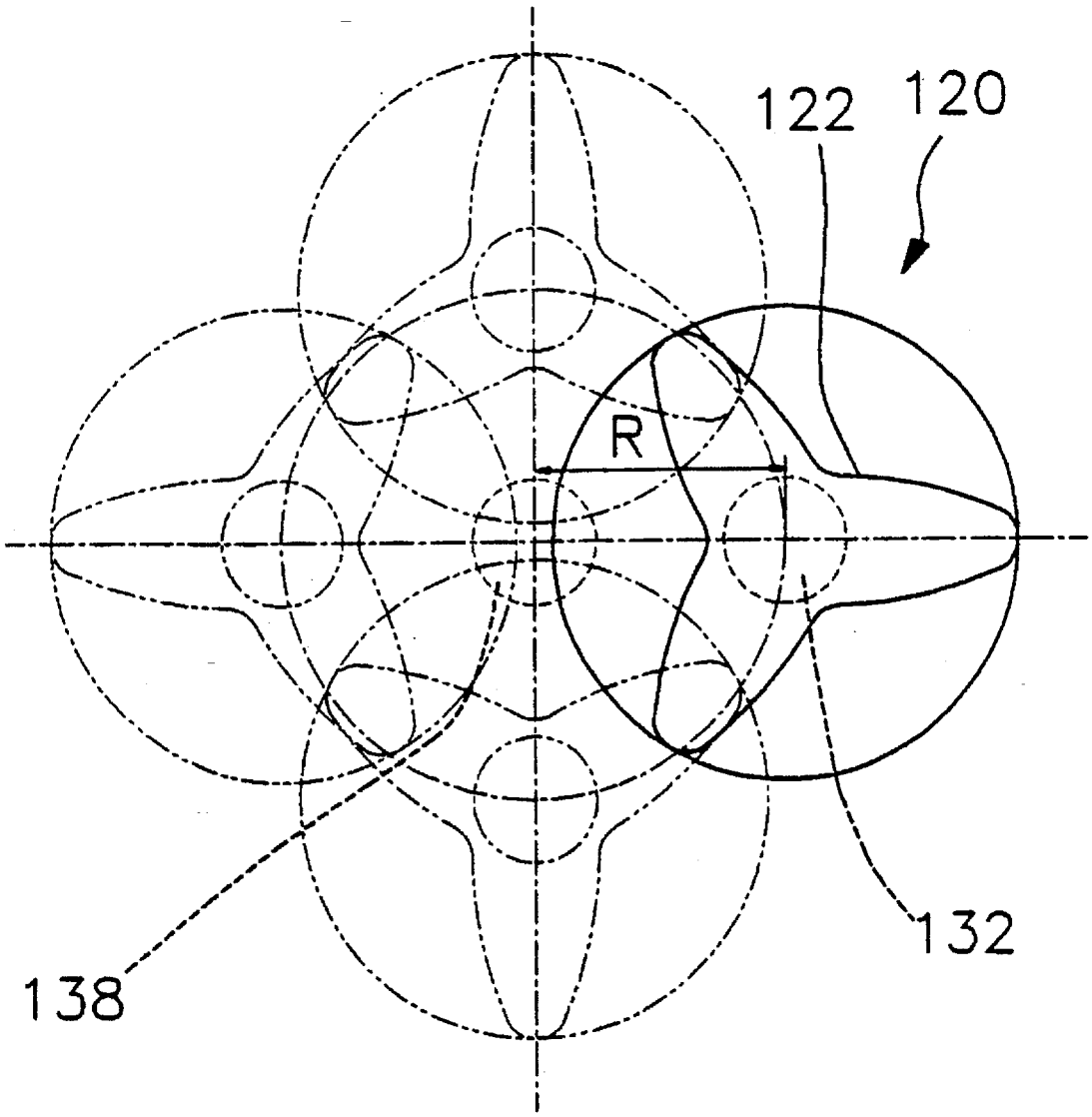
FIG. 3 is an enlarged plan view of a pulsator as shown in FIG. 1, for showing the pseudo-rotation movement of the pulsator in a washing tub.

That is, as shown in FIG. 3 in detail, pulsator 120, which is secured to upper shaft 132 of eccentric link 130 and disposed in the lower portion of washing tub 110, is circularly moved along the circular orbit shown as phantom line in FIG. 3 together with upper shaft 132 of eccentric link 130. At this moment, though pulsator 120 does not rotate on its own axis, pulsator 120 performs so called "pseudo-rotation movement", which is similar to a rotation movement, while moving around lower shaft 138 of eccentric link 130. The "pseudo-rotation movement" means that pulsator 120 moving along the circular orbit seems to be rotated on its own axis though pulsator 120 does not rotate on its own axis. That is, an eccentric distance R between upper shaft 132 and the rotation axis of lower shaft 138 is so short that a radius of the circular movement of pulsator 120 is described in a short length. In addition, since the number of cycles of circular movements of pulsator 120 is in proportion to the number of rotations of lower shaft 138, the circular movement of pulsator 120 is performed quickly so that positions of blades 122 of pulsator 120 are quickly changed at an angle of 360 degrees as shown in FIG. 3. For this reason, pulsator 120 performing the circular movement about lower shaft 138 of eccentric link 130 seems to be rotated on its own axis.

Since a center of pseudo-rotating pulsator 120 is not fixed in one spot of washing tub 110, the pseudo-rotating pulsator 120 generates a irregular liquid flow in washing tub 110 different from the liquid flow generated by the rotation movement of conventional pulsator 420 so that the tangling of the washing objects moved along the liquid flow in washing tub 110 can be reduced. In addition, since a center of pseudo-rotating pulsator 120 is circularly moved in washing tub 110 about lower shaft 138 of eccentric link 130, centrifugal force is reduced so that the washing objects do not collide with the side wall of washing tub 110 strongly, and thereby the damage to the washing objects can be reduced.

The eccentric distance R between upper shaft 132 and lower shaft 138 of eccentric link 130 is in relation to the liquid flow generated by the pseudo-rotation movement of pulsator 120. Accordingly, it should be selected properly.

On the other hand, when pulsator 120 is doing the pseudo-rotation movement, weighty portion 136 formed integrally with base plate 134 of eccentric link 130 keeps the center of gravity of eccentric link 130 constant in such a manner that the pseudo-rotation movement of pulsator 120 can be stably performed. In other words, weighty portion 136 prevents movement of the center of gravity of eccentric link 130 caused by a weight of pulsator 120 so that the pseudo-rotation movement of pulsator 120 can be stably performed without a fluctuation.

In addition, bellows 112 formed in the bottom wall of washing tub 110 prevent a leakage of washing liquid between washing tub 110 and upper shaft 132 of eccentric link 130 during the washing operation. Bellows 112 are made of a flexible material and have a moving area at its center portion in such a manner that upper shaft 132 of eccentric link 130 can easily perform the circular movement.

According to another embodiment of the present invention, lower shaft 138 of eccentric link 130, instead of upper shaft 132, passes through the bottom wall of washing tub 110. In this case, lower shaft 138 of eccentric link 130 rotates on its own axis so that the moving area of bellows 112 is not required at its center portion.

Washing time for washing the washing objects is adjustable by adjusting a washing timer 190 the same as conventional washing machine 400.

In addition, after the washing operation has finished, the dehydration operation for dehydrating the washing liquid contained in the washed washing objects is performed in a well-known manner the same as conventional washing machine 400.

On the other hand, eccentric link 130 of the present invention is also applicable to a one-tub type washing machine.

Figure 4:
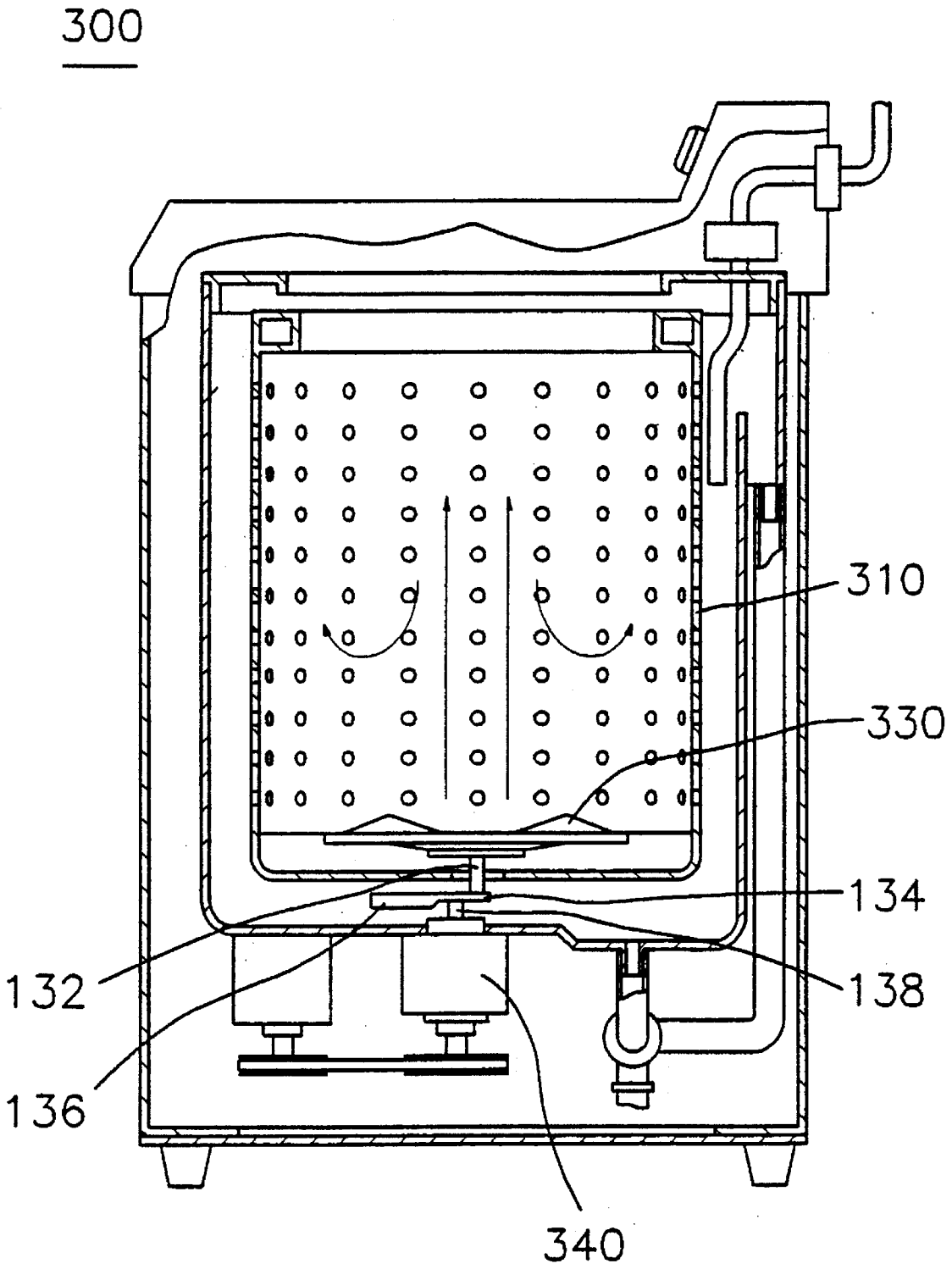
FIG. 4 is a sectional view of a one-tub type washing machine, in which the eccentric link as shown in FIG. 2 is applied thereto.
Figure 5:
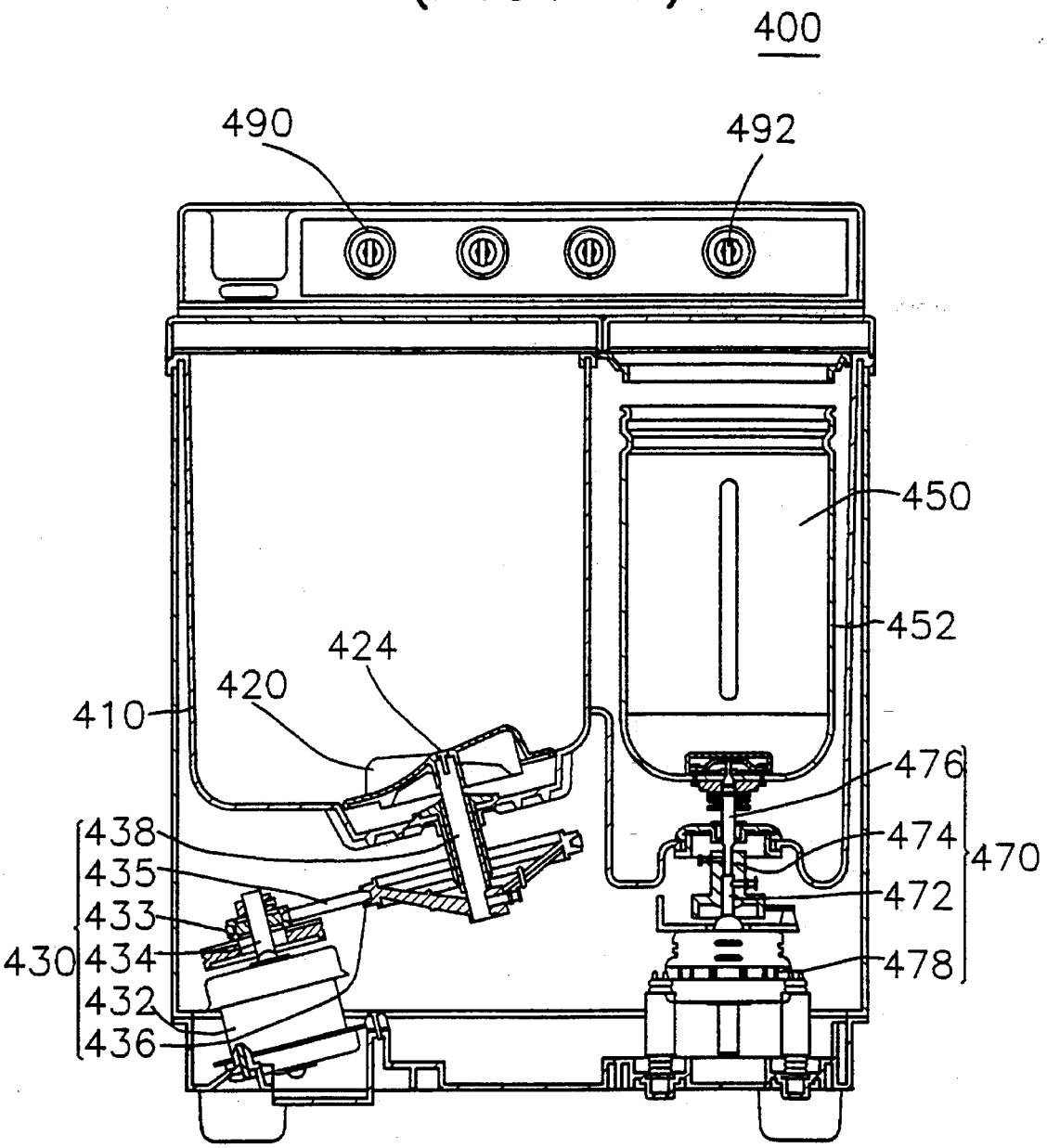
FIG.5 (PRIOR ART)
FIG. 5 is a sectional view of a conventional two-tub type washing machine.

FIG. 4 shows a one-tub type washing machine 300 in which eccentric link 130 of the present invention is applied thereto.

As shown in FIG. 4, each upper shaft 132 and lower shaft 138 of eccentric link 130 is connected to a pulsator 330 and a motor 340, respectively. In connection with eccentric link 130 of the present invention, one-tub type washing machine has the same operation manner as the above described one-tub type washing machine 100. That is, when lower shaft 138 of eccentric link 130 driven by motor 340 is rotated on its own shaft, upper shaft 132 moves circularly so that pulsator 330 connected to upper shaft 132 of eccentric link 130 is pseudo-rotating, and thereby a irregular liquid flow is generated in a washing tub 310. Since such an operation of eccentric link 130 is explained enough in relation to above described one-tub type washing machine 100, it will not be further described in relation to one-tub type washing 300.

As described above, since the rotation axis of pulsator 120 is not fixed in one spot, pulsator 120 of washing machine 100 having eccentric link 130 according to the present invention generates an irregular liquid flow, which is different from the liquid flow generated by pulsator 420 of conventional washing machine 400 so that the tangling of washing objects moved along the irregular liquid flow can be reduced.

Further, since the center of pulsator 120 generating the liquid flow is circularly moved in washing machine 110, centrifugal force in washing tub 110 is reduced so that the damage of the washing objects caused by their colliding with the side wall of washing tub 110 can be reduced.

Furthermore, eccentric link 130 according to the present invention can be easily manufactured and at an inexpensive cost.

While the present invention has been particularly shown and described with reference to the preferred embodiments thereof, it will be understood by those skilled in the art that various changes in form and details may be effected therein without departing from the spirit and scope of the invention as defined by the appended claims.

What is claimed is:

1. A washing machine comprising:

a washing tub for receiving a washing object, the washing tub having a bellows at a bottom wall of the washing tub;

a pulsator mounted above the bottom wall of the washing tub and having a plurality of blades for generating a liquid flow in the washing tub;

a pulsator driving section for driving the pulsator; and a means for transferring a driving force from the pulsator driving section to the pulsator, the transferring means being disposed between the pulsator driving section and the pulsator and receiving a rotational force from the pulsator driving section so as to pseudo-rotate the pulsator in the washing tub, wherein the transferring means includes an eccentric link having a base plate, an Upper shaft formed on an upper surface of the base plate and connected to the pulsator, and a lower shaft formed on a lower surface of the base plate and connected to the pulsator driving section, the upper shaft being eccentrically disposed with respect to the lower shaft in such a manner that the Upper shaft may circularly move about the lower shaft as the lower shaft is rotated on its own axis, and wherein the base plate of the eccentric link has a weighty portion for maintaining the center of gravity of an eccentric link constant, the weighty portion being formed thicker than a remaining portion of the base plate.

2. The washing machine as claimed in claim 1, wherein the upper shaft and the lower shaft are disposed in opposite direction from each other and formed integrally with the base plate.

3. The washing machine as claimed in claim 1, wherein the pulsator driving section includes a washing motor for generating a rotational force, a first pulley receiving the rotational force from the washing motor through a motor shaft so as to be rotated, a second pulley connected to the lower shaft of the eccentric link, and a belt for connecting the first pulley to the second pulley.

4. The washing machine as claimed in claim 1, wherein the bellows are made of a flexible material and having a moving area at its center portion, the upper shaft of the eccentric link is passing through the moving area in such a manner that the upper shaft may easily move around the lower shaft.

5. A washing machine comprising:

a washing tub for receiving a washing object, the washing tub having a bellows at a bottom wall of the washing tub, the bellows having a moving area at its center portion and being comprised of a flexible material;

a pulsator mounted above the bottom wall of the washing tub and having a plurality of blades for generating a liquid flow in the washing tub;

an eccentric link having a base plate, an upper shaft formed on an upper surface of the base plate and connected to the pulsator, and a lower shaft formed on a lower surface of the base plate and connected to the pulsator driving section, the upper shaft being eccentrically disposed with respect to the lower shaft in such a manner that the upper shaft may circularly move about the lower shaft as the lower shaft is rotated on its own axis, the base plate having a weighty portion formed thicker than remaining portion of the base plate so as to maintain the center of gravity of eccentric link constant, the upper shaft passing through the moving area of the bellows in such a manner that the upper shaft may easily move around the lower shaft, the upper shaft and the lower shaft are disposed in opposite direction from each other and formed integrally with the base plate; and a pulsator driving section having a washing motor for generating a rotational force, a first pulley receiving the rotational force from the washing motor through a motor shaft so as to be rotated thereof, a second pulley connected to the lower shaft of the eccentric link, and a belt for connecting the first pulley to the second pulley, wherein the eccentric link is disposed between the pulsator driving section and the pulsator, and receives a rotational force from the pulsator driving section so as to pseudo-rotate the pulsator in the washing tub, the pulsator is secured to the upper shaft of the eccentric link so that the pulsator is circularly moved around the lower shaft together with the upper shaft as the lower shaft is rotated on its own axis, and thereby an irregular liquid flow is generated in the washing tub.

* * * * *